US005265296A

United States Patent [19]

Abbas et al.

[11] Patent Number: 5,265,296

[45] Date of Patent: Nov. 30, 1993

[54] AUTOMATIC DISPOSABLE UNDER PAD APPARATUS

[76] Inventors: Ahsan Abbas, 331 N. Ardmore #C, Villa Park, Ill. 60181; Panagiotis Valeros, 6412 N. Washtenaw, Chicago, Ill. 60645

[21] Appl. No.: 47,681

[22] Filed: Apr. 12, 1993

[51] Int. Cl.[5] ..... A61G 7/00

[52] U.S. Cl. ..... 5/612; 5/453; 5/488

[58] Field of Search ..... 5/600, 612, 81.1, 83.1, 5/84.1, 89.1, 449, 453, 464, 463, 482, 484, 487, 488

[56] References Cited

U.S. PATENT DOCUMENTS

| | | | |
|---|---|---|---|
| 595,734 | 12/1897 | Rand et al. | 5/464 |
| 4,993,091 | 2/1991 | Draper et al. | 5/488 |
| 5,161,267 | 11/1992 | Smith | 5/84.1 |

FOREIGN PATENT DOCUMENTS

| | | | |
|---|---|---|---|
| 81455 | 7/1952 | Norway | 5/84.1 |
| 578345 | 8/1974 | Switzerland | 5/463 |

*Primary Examiner*—Alexander Grosz
*Attorney, Agent, or Firm*—Richard L. Miller

[57] ABSTRACT

An automatic disposable under pad apparatus for a hospital bed is provided which consists of a frame and a mattress having a central inflatable transverse section. The mattress is supported on the frame along with a structure for supporting a hip portion of a patient that is reclining on the mattress over the central inflatable transverse section. A dispensing mechanism allows a roll of clean under pads to have a portion extendable over the central inflatable transverse section of the mattress and under the patient. A device is also provided for inflating and deflating the central inflatable transverse section of the mattress. When the patient soils the extended portion of the roll of clean under pads the central inflatable transverse section may be deflated while the supporting means will simultaneously keep the hip portion of the patient elevated, allowing another portion of the roll of clean under pads to be pulled under the hip portion of the patient, before the inflatable transverse section is inflated again.

5 Claims, 1 Drawing Sheet

AUTOMATIC DISPOSABLE UNDER PAD APPARATUS

BACKGROUND OF THE INVENTION

The instant invention relates generally to hospital beds and more specifically it relates to an automatic disposable under pad apparatus for a hospital bed.

Numerous hospital beds equipped with various under pinning apparatus have been provided in the prior art for patients to recline, and/or sleep. For example, U.S. Pat. Nos. 3,528,421 to Vaillancourt etal; 5,005,231 to Lonardo and 5,020,170 to Ruf all are illustrative of such prior art. While these units may be suitable for the particular purpose to which they address, they would not be as suitable for the purpose of the present invention as hereafter described.

SUMMARY OF THE INVENTION

A primary object of the present invention is to provide an automatic disposable under pad apparatus for a hospital bed that will overcome the shortcomings of the prior art devices.

Another object is to provide an automatic disposable under pad apparatus for a hospital bed, so that a nurse can change the disposable under pad on a bed occupied by an immobilized and incontinent patient, without having to remove the patient from the hospital bed.

An additional object is to provide an automatic disposable under pad apparatus for a hospital bed that will give comfort to the patient, while the under pad is being changed.

A further object is to provide an automatic disposable under pad apparatus for a hospital bed that is simple and easy to use.

A still further object is to provide an automatic disposable under pad apparatus for a hospital bed that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
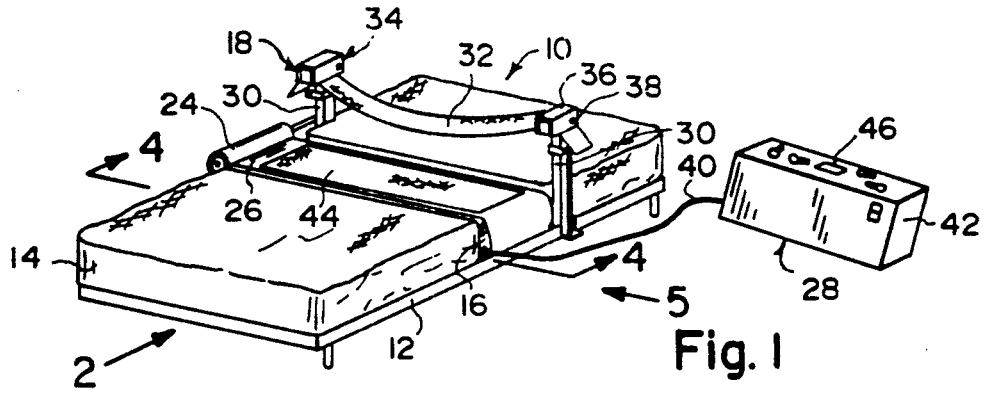
FIG. 1 is a diagrammatic perspective view of the instant invention.
Figure 2:
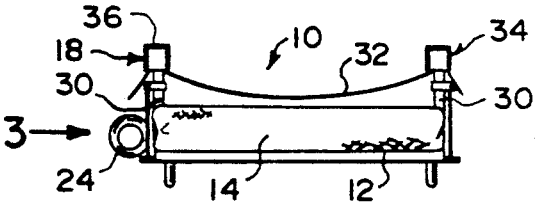
FIG. 2 is an end view taken in the direction of arrow 2 in FIG. 1.
Figure 3:
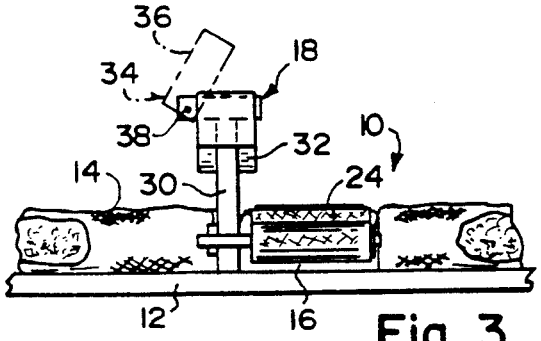
FIG. 3 is an enlarged left side view with parts broken away taken in the direction of arrow 3 in FIG. 2.
Figure 4:
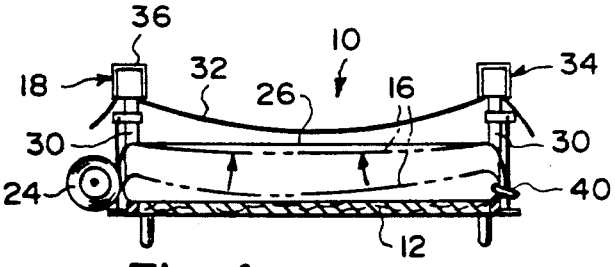
FIG. 4 is an enlarged diagrammatic cross sectional view taken on line 4—4 of FIG. 1.
Figure 5:
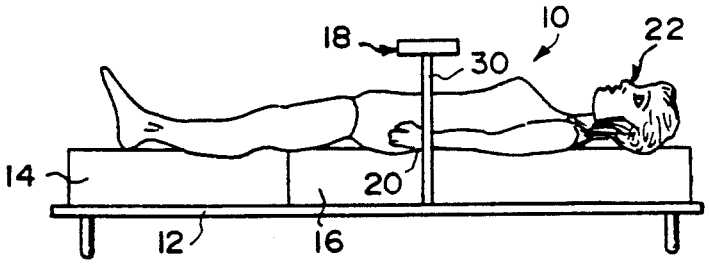
FIG. 5 is an enlarged diagrammatic right side view taken in the direction of arrow 5 in FIG. 1 with a patient in a reclining position.
Figure 6:
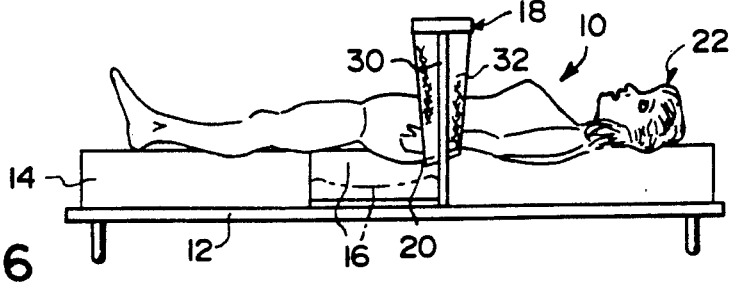
FIG. 6 is an enlarged diagrammatic right side view with the patient being partially supported by a strap, while the air mattress is deflated to allow changing of the under pads.

Turning now descriptively to the drawings, in which similar reference characters denote similar elements throughout the several views, FIGS. 1 through 6 illustrates an automatic disposable under pad apparatus for a hospital bed 10, which consists of a frame 12 and a mattress 14 having a central inflatable transverse section 16. The mattress 14 is supported on the frame 12. A structure 18 is for supporting a hip portion 20 of a patient 22 that is reclining on the mattress 14 over the central inflatable transverse section 16. A roll of clean under pads 24 has a portion 26 extendable over the central inflatable transverse section 16 of the mattress 14. A device 28 is for inflating and deflating the central inflatable transverse section 16 of the mattress 14, when the patient 22 soils the extended portion 26 of the roll of clean under pads 24, the central inflatable transverse section 16 will be deflated. The supporting structure 18 will keep the hip portion 20 of the patient 22 elevated, allowing another portion 26 of the roll of clean under pads 24 to be pulled under the hip portion 20 of the patient 22, while the inflatable transverse section 16 is inflated again.

The supporting structure 18 includes a pair of adjustable stanchions 30, with each mounted to an opposite side of the frame 12 adjacent the central inflatable transverse section 16. A strap 32 extends underneath the hip portion 20 of the patient 22. An apparatus 34 is for securing each opposite end of the strap 32 to each stanchion 30. Each securing apparatus 34 is a grip clamp 36, pivotally mounted at 38 to a top end of the respective stanchion 30, so that the grip clamp 36 can lock onto the respective end of the strap 32.

The inflating and deflating device 28 contains an elongated tube 40, having a first end extending from one side of the central inflatable transverse section 16 of the mattress 14. An air compressor control unit 42, as shown in FIG. 1, is connected to a second end of the elongated tube 40 to inflate and deflate the central inflatable transverse section 16.

A moisture sensor pad 44 is placed upon the central inflatable transverse section 16 of the mattress 14. A moisture sensor indicator 46 is on the air compressor control unit 42 and is electrically connected to the moisture sensor pad 44. When the patient 22 soils the extended portion 26 of the roll of clean under pads 24, the moisture sensor pad 44 will detect the moisture and send a signal to the moisture sensor indicator 46, to alert a nurse to pull out another portion 26 of the roll of clean under pads 24 under the patient 22.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An automatic disposable under pad apparatus for a hospital bed which comprises:

a) a frame;

b) a mattress having a central inflatable transverse section, said mattress supported on said frame;

c) means for supporting a hip portion of a patient that is reclining on said mattress over said central inflatable transverse section;

d) means for dispensing a roll of clean under pads having a portion extendable over said central inflatable transverse section of said mattress; and e) means for inflating and deflating said central inflatable transverse section of said mattress, so that when the patient soils the extended portion of said roll of clean under pads, said central inflatable transverse section may be deflated, with said supporting means keeping the hip portion of the patient elevated, allowing another portion of said roll of clean under pads to be pulled under the hip portion of the patient, before said inflatable transverse section in inflated again.

2. An automatic disposable under pad apparatus as recited in claim 1, wherein said supporting means includes:

a) a pair of adjustable stanchions, each mounted to an opposite side of said frame adjacent said central inflatable transverse section;

b) a strap to extend underneath the hip portion of the patient; and c) means for securing each opposite end of said strap to each said stanchion.

3. An automatic disposable under pad apparatus as recited in claim 2, wherein each said securing means is a grip clamp pivotally mounted to a top end of said respective stanchion, so that said grip clamp can lock onto said respective end of said strap.

4. An automatic disposable under pad apparatus as recited in claim 3, wherein said inflating and deflating means includes:

a) an elongated tube having a first end fluidly connected and extending from one side of said central inflatable transverse section of said mattress; and b) an air compressor control unit fluidly connected to a second end of said elongated tube to inflate and deflate said central inflatable transverse section.

5. An automatic disposable under pad apparatus as recited in claim 4, further including:

a) a moisture sensor pad placed upon said central inflatable transverse section of said mattress; and b) a moisture sensor indicator on said air compressor control unit, electrically connected to said moisture sensor pad, so that when the patient soils the extended portion of said roll of clean under pads, said moisture sensor pad will detect the moisture and send a signal to said moisture sensor indicator to alert a nurse to change the portion of said roll of under pads under the patient.

* * * * *